US006484641B2

(12) United States Patent
Carreiro

(10) Patent No.: US 6,484,641 B2
(45) Date of Patent: Nov. 26, 2002

(54) CRUISE MISSILE DOWNED AIRMAN DECOY

(75) Inventor: Paul J. Carreiro, Swansea, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 09/822,309

(22) Filed: Mar. 30, 2001

(65) Prior Publication Data

US 2002/0148377 A1 Oct. 17, 2002

(51) Int. Cl.[7] ..... F42B 12/36

(52) U.S. Cl. ..... 102/489; 102/387; 102/374; 102/393; 455/98; 89/1.51; 244/137.3; 244/149

(58) Field of Search ..... 102/293, 374, 102/387, 393, 489, 505; 89/1.51, 155; 244/137.1, 137.3, 142, 149; 455/95–98; 342/386

(56) References Cited

U.S. PATENT DOCUMENTS 2,551,609 A * 5/1951 Kohr et al. ..... 102/387
2,778,587 A * 1/1957 Moran ..... 244/150
2,967,677 A * 1/1961 Winzen et al. ..... 244/137.3
3,465,251 A * 9/1969 Meek et al. ..... 455/97
3,715,668 A * 2/1973 Herring et al. ..... 455/96
4,172,407 A * 10/1979 Wentink ..... 102/489
4,455,943 A * 6/1984 Pinson ..... 102/489
6,195,039 B1 * 2/2001 Glass, jr. ..... 342/357.09

* cited by examiner

*Primary Examiner*—Harold J. Tudor
(74) *Attorney, Agent, or Firm*—Michael J. McGowan; James M. Kasischke; Michael F. Oglo

(57) ABSTRACT

A cruise missile, such as the Tomahawk cruise missile, is adapted to deploy decoys in an area as the missile progresses along its preprogrammed course. Each decoy is shaped to be compatible with and ejected from the Tomahawk and has a preprogrammed control unit operating a transmitter connected to an extendible antenna. False beacon signals and/or false message signals are transmitted from each of the decoys to deceive and confuse defensive forces, such as enemy searchers looking for a downed airman.

17 Claims, 2 Drawing Sheets

CRUISE MISSILE DOWNED AIRMAN DECOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to decoys emitting radio signals to increase the survivability of a downed airman. More particularly, this invention relates a cruise missile deploying a preprogrammed pattern of decoys each having a radio transmitter to confuse enemy searchers.

(2) Description of the Prior Art

One of the hazards of air operations in airspace over enemy territory is the possibility of losing aircraft. Once an airman is forced to abandon the aircraft, the parachute, training, and survival equipment must be relied upon to evade capture and to contact friendly search and rescue teams for rescue. One essential element to make possible an eventual rescue is the portable radio carried by downed airmen (e. g. an AN/PRC-90) that permits voice communications or a radio-signal beacon for friendly searchers to home in on. Usually signals are transmitted at specific times using codes set at the pre-mission briefing. A combination of voice and beacon transmissions guides rescuers to an appropriate pick-up point. However, like all radio frequency transmissions, these signals are susceptible to interception by enemy forces and location of the source by their directional radio antennas. This puts not only the airman in peril, but also the aircraft and personnel of the search-and-rescue teams.

Thus, in accordance with this inventive concept, a need has been recognized in the state of the art for a system to quickly deploy patterns of decoys that emit radio signals to confuse and mislead hostile searchers for a downed airman.

SUMMARY OF THE INVENTION

The first object of the invention is to provide a plurality of decoys each emitting radio signals to improve the chances of survivability and evasion by downed airmen.

Another object of the invention is to provide a cruise missile deploying decoys in a pattern to each emit radio signals that confuse and mislead unfriendly searchers for downed airmen.

Another object of the invention is to provide a cruise missile deploying radio-signal emitting decoys at standoff distances to avoid placing additional personnel and assets in jeopardy.

Another object of the invention is to provide a capability for a single launch platform to simultaneously deploy decoys emitting radio signals from cruise missiles in multiple fields, hundreds of miles apart.

Another object of the invention is to provide the capability of deploying cruise missiles that distribute decoys emitting radio signals in multiple, separated fields to deceive of and draw enemy troops and equipment in preparation of, or in conjunction with, an air strike.

These and other objects of the invention will become more readily apparent from the ensuing specification when taken in conjunction with the appended claims.

Accordingly, the present invention deploys decoys from one or more cruise missiles enabling transmission by radio transmitters on each decoy to thereby confusing and misleading enemy forces.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein like reference numerals refer to like parts and wherein.

DESCRIPTION OF THE PREFERRED EMBODIMENTS

Figure 1:
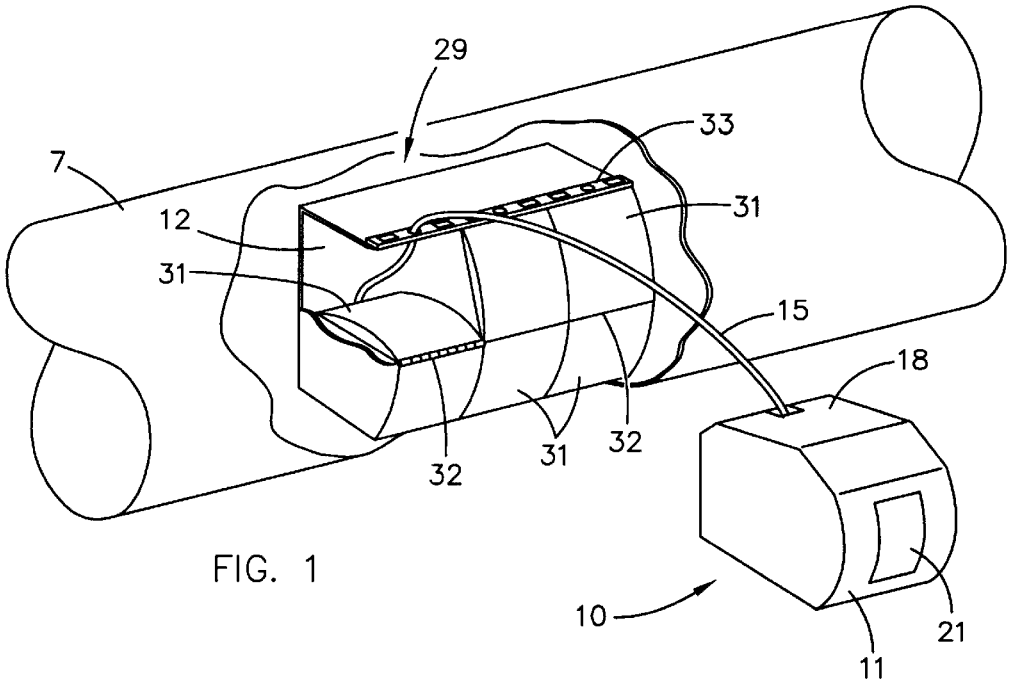
FIG. 1 is a schematic showing of a cruise missile deploying a decoy for emitting radio signals in accordance with this invention.

Referring to FIG. 1, a cruise missile 7 is shown as it flies a predetermined course and ejects a decoy 10 of this invention. Cruise missile 7 can be a submarine-launched Tomahawk cruise missile or some other radar-evading missile. In accordance with this invention, the Tomahawk cruise missile (UGM 109D), originally designed to deliver four payload modules of six small sub-munitions each to multiple targets, is adapted to carry a separate decoy 10 in a protective decoy shell 11 in each stowage space 12 and eject decoy 10 from its stowage space 12 in accordance with a predetermined launch sequence. This adaptation allows a single submarine or other launch platform to launch many decoys 10 from one or more cruise missiles in a wide field to transmit many false messages or radio beacons to deceive and confuse defensive forces.

Figure 2:
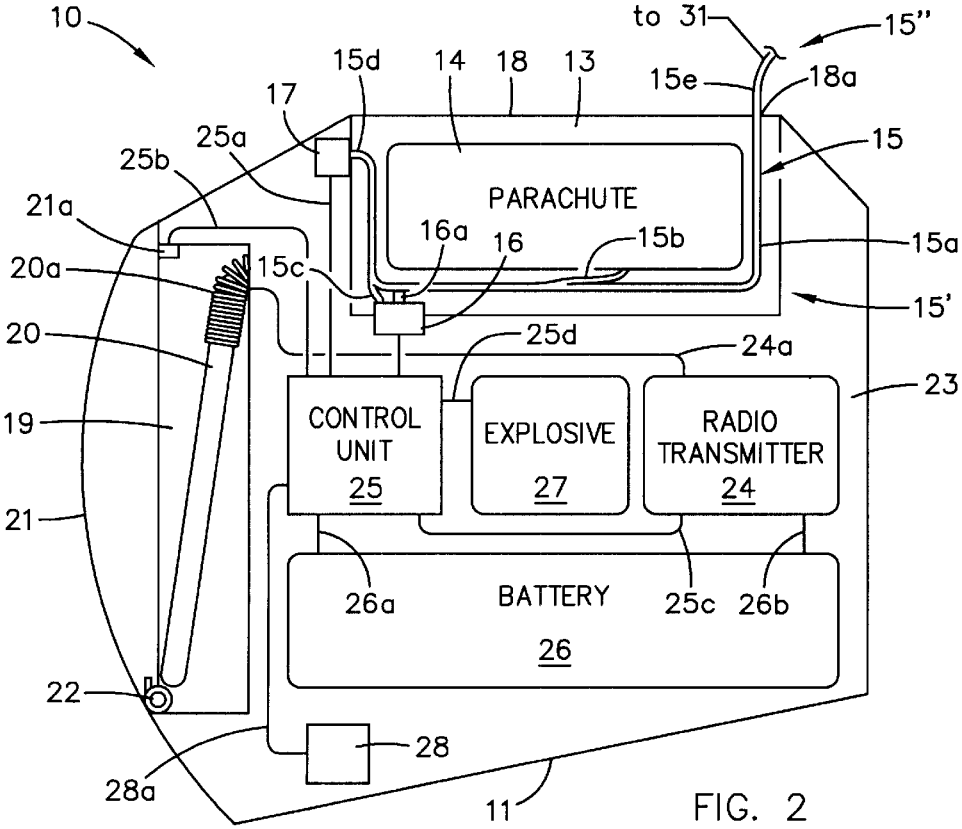
FIG. 2 is a cross-sectional view showing details of a decoy of this invention.

Referring to FIG. 2 in conjunction with FIG. 1, decoy shell 11 of each decoy 10 has virtually the same dimensions as the sub-munitions pack it replaces in stowage space 12 and is made from strong metal or plastic materials to provide impact and environmental protection for components of decoy 10. Decoy shell 11 is internally divided into three compartments, a parachute compartment 13 containing a folded parachute 14, an antenna compartment 19 housing an antenna 20, and a components compartment 23 containing a radio transmitter 24, control unit 25 and associated components.

Parachute compartment 13 in decoy shell 11 not only stows parachute 14, it additionally is provided with a lanyard 15, an arming switch 16, and a lanyard release 17. Lanyard 15 has a weak point, or weak point section 15*a* that is made to break and separate first and second sections 15' and 15". This separation, in turn, separates decoy 10 from missile 7 when decoy 10 is subjected to slipstream loading during the sequence of launch from missile 7. Lanyard 15 is secured to parachute 14 via lanyard portion 15*b*, to a pin 16*a* on arming switch 16 via lanyard portion 15*c*, and to a lanyard release 17 via lanyard portion 15*d* in the interior of parachute compartment 13. Lanyard portions 15*b*, 15*c*, and 15*d* together make up first section 15' of lanyard 15. Lanyard 15 is looped under parachute 14 and lanyard portion 15*e*, (second section 15" of lanyard 15) extends from parachute compartment 13 through a small slot 18*a* in a cover portion 18 of protective shell 11, and is secured to a closure door 31 of missile 7. Cover 18 is made of an easily frangible material, such as fabric or plastic that extends across folded parachute 14 to hold it in parachute compartment 13 prior to deployment of decoy 10 from cruise missile 7. A lanyard release 17 containing an ignitable or explosive squib is connected to lanyard portion 15*d* and to an inner wall of parachute compartment 13. Ignition of lanyard release 17 by a separation-control signal from control unit 25 separates lanyard 15 to free decoy 10 from parachute 14.

Protective shell 11 has an antenna compartment 19 that contains an elongate antenna 20 coupled to an antenna spring 20*a* that exerts a biasing force to urge antenna 20 to a position extending away from the rest of the components of decoy 10. Protective shell 11 is provided with an antenna compartment cover 21 that seals antenna compartment 19, protects antenna 20 and antenna spring 20*a* from the ambient, and holds antenna 20 inside of antenna compartment 19 prior to deployment. A cover latch 21*a* possibly containing an ignitable or explosive squib holds antenna compartment cover 21 in a closed position on antenna compartment 19 until an appropriate open-control signal on lead 25*b* from control unit 25 is coupled to it. Ignition of cover latch 21*a* by the open-control signal frees spring-loaded hinge 22 that has been held in compression to pivotally rotate antenna compartment cover 21 and open it so that antenna 20 may be extended outwardly from decoy 10 by the force of spring 20*a*.

Components compartment 23 of decoy 10 contains radio transmitter 24, control unit 25, battery 26, explosives 27 and motion sensor 28 plus their interconnections. Radio transmitter 24 is coupled by a lead 24*a* to antenna 20 to transmit radio signals. These radio signals can be preset in frequency and information content to act as false beacon signals or false message signals. The constituency of both these signals can be preprogrammed in transmitter 24 and transmitted in response to radio-control signals from control unit 25 that are communicated to transmitter 24 over lead 25*c*.

Control unit 25 is coupled to battery 26 via lead 26*a*, for transmitter 24 over lead 26*b* and for all other control functions for decoy 10. Control unit 25 provides the appropriate control signals mentioned hereinabove to effect internal control functions in decoy 10. Control unit 25 is connected via lead 28*a* to motion sensor 28 to receive motion signals representative of motion and/or changed orientation of decoy 10, for the purpose to be explained below. In addition, control unit 25 can couple a detonation-control signal over lead 25d to explosives 27 to detonate explosives 27 and destroy decoy 10 after a preset period or on receipt of outside stimulus, such as from motion sensor 28.

In operation, at least one cruise missile 7 located on board a launch platform is outfitted with decoys 10 and maintained in a state of readiness for launch of the decoys until notification arrives that an airman is downed in enemy territory. The attack party on the launch platform plots waypoints for a flight path over the designated area the airman is downed in and launches cruise missile 7. Many different patterns of flight over the designated area may be plotted to assure that missile 7 ejects decoys 10 at timed intervals between waypoints to effectively deceive enemy searchers.

In FIG. 1, cruise missile 7 is shown just after ejection of the last decoy 10 of one payload module 29. (There may be up to four payload modules on each Tomahawk cruise missile, and since each module holds 6 decoys, a total of 24 decoys can be deployed per missile.) The other decoys of payload module 29 have been deployed and closure doors 31 are shown rotated about an elongate hinge 32 and latched closed by latches 33 to provide fairings for the airframe of missile 7 for the rest of the flight. During and after ejection of decoy 10, payload module 29 works substantially the same it would using the existing Tomahawk UGM-109D with the exception that only one decoy 10 is ejected at a time as compared to the procedure of ejecting six sub-munitions at a time during conventional deployments of the sub-munitions.

Upon ejection of each decoy 10, lanyard portion 15*d* of lanyard 15 remains tethered to closure door 31 of its payload module 29. While lanyard 15 is being pulled taut, lanyard portion 15*d* pulls closure door 31 shut while simultaneously pulling parachute 14 through tear-through cover 18. As lanyard 15 continues to be pulled taut, lanyard portion 15*c* pulls pin 16*a* on arming switch 16 to activate control unit 25. After closure door 31 is pulled shut and latched by lanyard 15 and parachute 14 is clear of missile 7, the load created by the slipstream of ambient air around missile 7 breaks taut lanyard 15 at weak point section 15*a* to separate decoy 10 from missile 7. Decoy 10 falls freely to earth and completes deployment of parachute 14. The closed and latched closure doors 31 maintain a streamlined outer surface for missile 7 as it continues on its mission.

Figure 3:
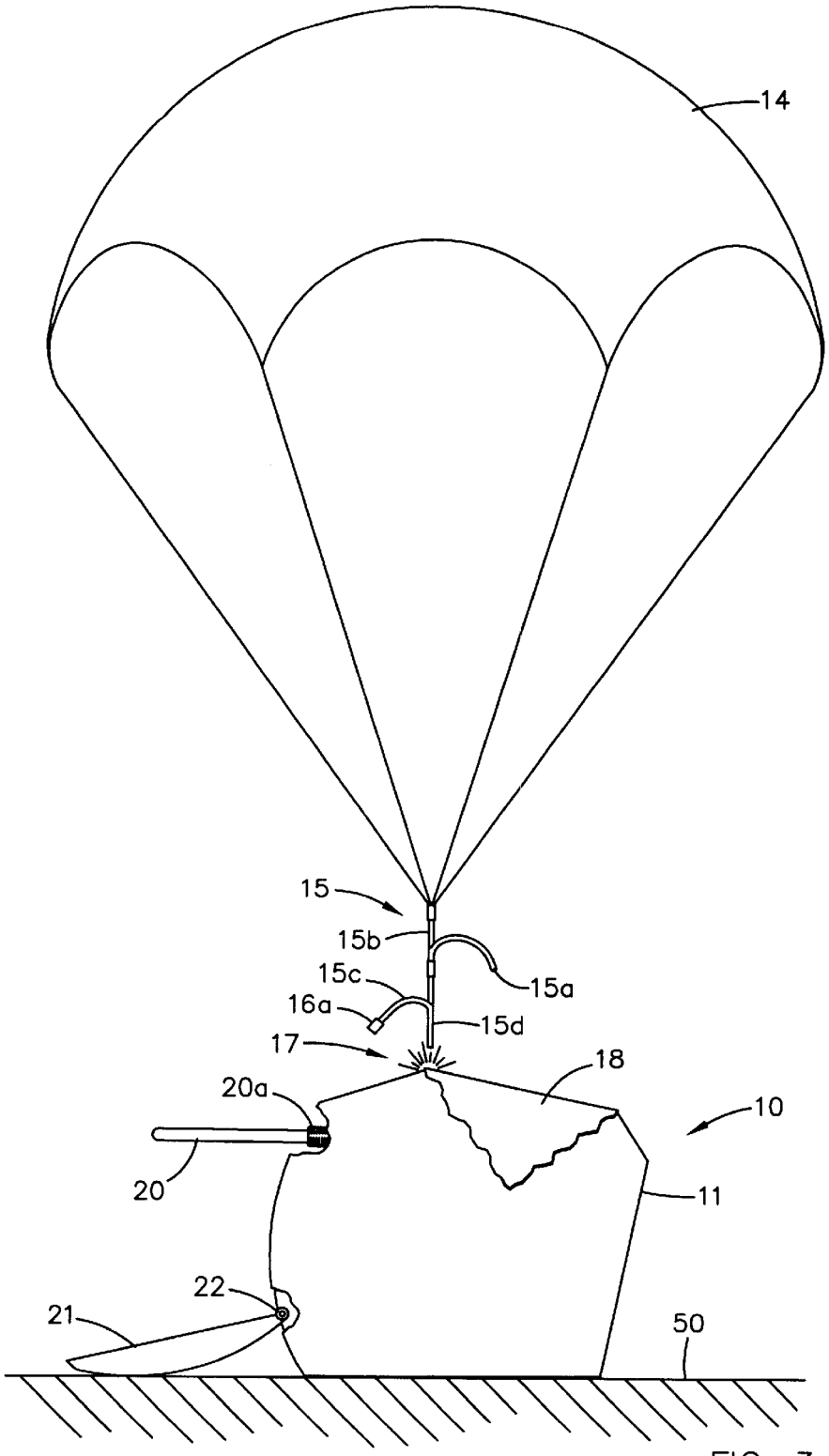
FIG. 3 depicts a radio beacon decoy separating from its parachute as it comes to rest on the ground.

Referring to FIG. 3 in conjunction with FIGS. 1 and 2, parachute 14 has filled and slowed the descent of decoy 10, and decoy 10 has just touched down on ground 50. On receipt of a signal from motion sensor 28 or after a first delay, control unit 25 provides a separation-control signal over lead 25*a* to initiate lanyard release 17 to separate parachute 14 from the rest of decoy 10. After a second delay, control unit 25 provides an open-control signal on lead 25*b* to fire cover latch 21*a* so that spring-loaded hinge 22 pivotally rotates and snaps open cover 21 of antenna compartment 29 to allow antenna spring 20*a* to laterally extend antenna 20. The curved surfaces of antenna compartment cover 21 and decoy shell 11 tend to prevent decoy 10 from coming to rest with antenna compartment 19 facing ground 50.

If, however, antenna compartment 19 does face ground 50, the relatively powerful spring-loaded hinge 22 is strong enough to pivotally rotate antenna compartment cover 21 and roll decoy 10 off antenna compartment 19 to allow antenna compartment cover 21 to open. With cover 21 forcefully rotated open by spring-loaded hinge 22, antenna 20 is extended from antenna compartment 19 by antenna spring 20*a*.

Now, or after a predetermined delay, control unit 25 activates radio transmitter 24 and may enable motion sensor 28. Control unit 25 cycles transmitter 24 intermittently to optionally transmit false message and/or beacon signals over a prolonged period of time. Control unit 25 can be programmed to send a detonation signal over lead 25*d* to detonate explosive 27 and destroy decoy 10. It may be expedient to destroy decoy 10 when the mission has been completed, the level of power in battery 26 falls below a specified level, a predetermined period has passed, or motion is sensed by motion sensor 28 that might indicate that decoy 10 is being tampered with.

Cruise missile 7 deploys decoys 10 at a safe standoff distance that does not place personnel and other assets in jeopardy in the vicinity of a downed crewmember. During intense air operations, a single submarine can be called upon to launch one or more cruise missiles 7 to simultaneously lay multiple fields of decoys 10. These fields may be hundreds of miles apart to confuse searchers for several downed airmen at different locations. In addition to deceiving unfriendly searchers for downed airmen, decoys 10 may be dispersed in preparation of, or in conjunction with, an air strike or landing to deceive and draw away enemy troops and equipment.

The deployment of deceptive decoys 10 using existing cruise missiles 7 is an extension of the field of tactical application of this missile to further assure retention of this missile in inventory. After delivering the decoys, missile 7, outfitted with GPS and using residual fuel as an incendiary could attack a specific target. Providing floats on each decoy 10 could permit use of such decoys over water for the purpose of confusing enemy searchers or tactically deceiving enemy naval forces. Cruise missile 7 and/or decoys 10 could be provided with cameras to gather and relay information on enemy strength and movements via loitering missile 7 and/or deployed decoys 10.

The disclosed components and their arrangements as disclosed herein all contribute to the novel features of this invention. Decoy 10 and the deployment thereof by cruise missile 7 provide reliable and cost-effective means to help downed airmen deceive and evade capture by enemy defense forces. Therefore, decoy 10 and its deployment by cruise missile 7 as disclosed herein are not to be construed as limiting, but rather, are intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for providing decoy signals comprising:

a cruise missile having a plurality of payload module bays formed therein;

a plurality of decoys, each decoy being positioned before deployment in one said payload module bay in said cruise missile and being ejected from said payload module bay upon deployment, each decoy comprising:

a shell;

a lanyard joining said shell to said cruise missile, said lanyard extending on deployment of said decoy and said lanyard having a weak point for parting said lanyard when said lanyard becomes taut upon deployment;

a parachute joined to said shell and to said lanyard, said lanyard deploying said parachute upon extension;

a control unit positioned inside said shell for controlling said decoy;

a radio transmitter positioned inside said shell and joined to said control unit for providing radio signals on command from said control unit; and an antenna positioned inside said shell and joined to said radio-transmitter for transmitting decoy signals.

2. A system according to claim 1 wherein said decoy further comprises an arming switch joined between said control unit and said lanyard, said arming switch transmitting an arming signal to said control unit for arming said decoy upon extension of said lanyard.

3. A system according to claim 2 wherein said decoy further comprises a squib charge provided between said parachute and said shell and joined to said control unit, said control unit activating said squib charge and separating said parachute from said shell after passage of a predetermined period of time.

4. A system according to claim 3 further comprising an antenna deployment means joined to said antenna and said control unit, said antenna deployment means receiving a control signal from said control unit and deploying said antenna after a second predetermined period of time, and said antenna transmitting decoy signals.

5. A system according to claim 4 wherein said decoy further comprises a motion sensor positioned in said shell and joined to said control unit for providing an indication of motion to said control unit.

6. A system according to claim 2 wherein said decoy further comprises a squib charge provided between said parachute and said shell and joined to said control unit, said control unit activating said squib charge and separating said parachute from said shell upon receipt of a signal from a motion sensor indicating said decoy has landed.

7. A system according to claim 6 further comprising an antenna deployment means joined to said antenna and said control unit, said antenna deployment means receiving a control signal from said control unit and deploying said antenna after a predetermined period of time after receipt of said landing indication signal from said motion sensor, and said antenna transmitting decoy signals on deployment.

8. A system according to claim 7 wherein said decoy further comprises an explosive charge positioned in said shell and joined to said control unit, said control unit providing a signal activating said explosive charge on occurrence of one of the following events: passage of a predetermined period of time after deployment, receipt of a signal at said motion sensor indicating tempering, and low power availability.

9. A decoy comprising:

a protective shell sized to fit within a stowage space of a cruise missile, said shell having an antenna compartment, a parachute compartment, and a components compartment;

a tear through cover disposed on said shell covering said parachute compartment;

an antenna disposed in said antenna compartment;

a parachute disposed in said parachute compartment;

a lanyard disposed in said parachute compartment, said lanyard having a first section connected to said parachute, and a lanyard release secured to said shell, a second section extending through said tear-through cover and connectable to a closure door of the missile, and a weak point section between said first and second sections;

an arming switch joined to said lanyard which activates on deployment of said lanyard;

a radio transmitter disposed in said components compartment and coupled to said antenna to transmit signals therefrom;

a control unit disposed in said components compartment and connected to said arming switch and said radio transmitter; and a battery power supply connected to said radio transmitter and said control unit, said battery power supply being disposed in said components compartment.

10. A decoy according to claim 9 wherein said arming switch has a pin joined to said lanyard and said lanyard becomes taut after ejection of said shell from the missile to pull said pin from said arming switch to activate said control unit.

11. A decoy according to claim 10 wherein said weak point section in said lanyard breaks to separate said first section and said second section of said lanyard for separating the missile and said shell when said shell is subjected to slipstream loading.

12. A decoy according to claim 11 further comprising an antenna compartment cover joined to said shell and covering said antenna compartment in a first position and uncovering said antenna compartment in a second position.

13. A decoy according to claim 12 further comprising:

a spring loaded hinge pivotally mounting said antenna compartment cover on said shell at said antenna compartment; and a cover latch securing said antenna compartment cover on said shell at said antenna compartment, said cover latch being connected to said control unit to receive an open-control signal to release said antenna compartment cover to permit pivotal rotation by said spring loaded hinge to open said antenna compartment cover.

14. A decoy according to claim 13 further comprising an antenna spring connected between said shell in said antenna compartment and said antenna to extend said antenna from said open antenna compartment when said antenna compartment is open.

15. A decoy according to claim 14 wherein said spring-loaded hinge has sufficient strength to pivotally rotate said shell such that said antenna compartment cover faces said antenna away from ground.

16. A decoy according to claim 15 further comprising a motion sensor positioned in the shell and connected to said control unit to provide signals representative of motion thereof.

17. A decoy according to claim 16 further comprising explosives positioned in the shell and connected to said control unit, said control unit sending a detonation signal to detonate said explosives as one of the following occurs: power of said power supply battery falls below a specified level, a predetermined period passes, and said motion sensor indicates tampering.

* * * * *